US005693248A

United States Patent [19]

Kim

[11] Patent Number: 5,693,248

[45] Date of Patent: Dec. 2, 1997

[54] SENSOR MALFUNCTION PREVENTION APPARATUS FOR MICROWAVE OVEN

[75] Inventor: Seog Tae Kim, Kyungsangnam-Do, Rep. of Korea

[73] Assignee: LG Electronics Inc., Rep. of Korea

[21] Appl. No.: 583,439

[22] Filed: Jan. 5, 1996

[30] Foreign Application Priority Data

Jul. 7, 1995 [KR] Rep. of Korea ..... 16685/1995
Jul. 24, 1995 [KR] Rep. of Korea ..... 18211/1995

[51] Int. Cl.[6] ..... H05B 6/68

[52] U.S. Cl. ..... 219/711; 219/707; 219/757

[58] Field of Search ..... 219/711, 710, 219/757, 707, 704

[56] References Cited

U.S. PATENT DOCUMENTS 4,131,779 12/1978 Tatsukawa et al. ..... 219/711
5,015,812 5/1991 Kasai et al. ..... 219/711

FOREIGN PATENT DOCUMENTS 59-29926 2/1984 Japan ..... 219/711
61-243224 10/1986 Japan ..... 219/757
4-93521 3/1992 Japan ..... 219/757
5-10532 1/1993 Japan ..... 219/757
6-2860 1/1994 Japan ..... 219/757
6-109262 4/1994 Japan ..... 219/757

*Primary Examiner*—Philip H. Leung
*Attorney, Agent, or Firm*—Ostrolenk, Faber, Gerb & Soffen, LLP

[57] ABSTRACT

An improved sensor malfunction prevention apparatus for a microwave oven capable of preventing a malfunction and an infrared ray sensor from being polluted by dusts, food debris or the like from a cooking chamber, which includes a cooling fan; an air duct for guiding cooling air introduced into the interior of the microwave oven in cooperation with the cooling fan; a sensor support bracket disposed at a predetermined inner portion of the air duct; a sensor disposed at a predetermined potion of the sensor support bracket; a protective cover support disposed at the upper portion of the sensor support bracket for defining air openings between the protective cover and the sensor support bracket; and a protective cover fixed to the protective cover support.

4 Claims, 6 Drawing Sheets

SENSOR MALFUNCTION PREVENTION APPARATUS FOR MICROWAVE OVEN

BACKGROUND OF THE INVENTION

1. Field of the Invention

The present invention relates to a sensor malfunction prevention apparatus for a microwave oven, and particularly to an improved sensor malfunction prevention apparatus for a microwave oven capable of preventing a malfunction and an infrared ray sensor from being polluted by dust, food debris or the like from a cooking chamber.

2. Description of the Conventional Art

FIG. 1 shows a conventional microwave oven, which includes an infrared ray sensor 3 disposed at a sensor support 2 of a cavity upper plate 14.

A cooking chamber 1 having a turntable 4 disposed at a central portion of the cooking chamber 1 is provided inside the microwave oven. A hole 13 connected to the cooking chamber 1 is formed at the lower portion of the sensor support 2.

Meanwhile, a magnetron 7 is formed at one side wall of the cooking chamber 1, and an air duct 15 is formed for guiding air flow from the magnetron 7 to the cooking chamber 1.

In addition, a cooling fan 10 is disposed at one side wall of the microwave oven body 100 and near a periphery of the magnetron 7 and the air duct 15.

Reference numeral 5 denotes a driving motor for driving the turntable 4, 6 denotes a turntable support for supporting the turntable 4, 8 denotes a wave guide for guiding microwave generated by the magnetron 7 to the cooking chamber 1, 9 denotes an air discharging hole for discharging air in the cooking chamber 2 to the outside of the system, and 11 denotes a cooling fan guide.

The operation of the conventional microwave oven will now be explained with reference to the accompanying drawings.

To begin with, the conventional microwave oven 100 is directed to indirectly detecting the surface temperature of food placed on the upper surface of the turntable 4 through the holes 13 formed on the lower surface of the sensor support 2.

In addition, the microcomputer (not shown) controls the output of the magnetron 7 in accordance with a certain value outputted from the infrared sensor 3 and automatically cooks food 12 on the turntable.

At this time, the infrared sensor 3 is located at a central upper portion of the cooking chamber 1 at which it is easy to check the food 12 on the turntable and is directed to detecting infrared rays outputted from the food 12.

Therefore, since the infrared ray sensor 3 is exposed to pollution materials such as heat, vapor, and gas which come out of the cooking chamber, the above-mentioned pollution materials can easily attach to the surface of the infrared ray sensor 3, so that sensing capability of the same is decreased, and the automatic cooking operation can easily malfunction.

In addition, since the infrared ray sensor 3 is exposed to heat, easily overheat causing its sensing capability and life span to be decreased.

Moreover, since the hole 13 is clogged by food debris from the cooking chamber, malfunction of the microwave oven can occur.

SUMMARY OF THE INVENTION

Accordingly, it is an object of the present invention to provide a sensor malfunction prevention apparatus for a microwave oven, which overcome the problems encountered in a conventional sensor malfunction prevention apparatus for a microwave oven.

It is another object of the present invention to provide an improved sensor malfunction prevention apparatus for a microwave oven capable of preventing a malfunction and an infrared ray sensor from being polluted by dusts, food debris or the like from a cooking chamber.

To achieve the above objects, in accordance with a first embodiment of the present invention, there is provided a sensor malfunction prevention apparatus for a microwave oven, which includes a cooling fan; an air duct for guiding cooling air introduced into the interior of the microwave oven in cooperation with the cooling fan; a sensor support bracket disposed at a predetermined inner portion of the air duct; a sensor disposed at a predetermined portion of the sensor support bracket; a support for a protective cover disposed at the upper portion of the sensor support bracket for defining air openings between the protective cover and the sensor support bracket; and a light transparent protective cover fixed to the support of the protective cover.

To achieve the above objects, in accordance with a second embodiment of the present invention, there is provided a sensor malfunction prevention apparatus for a microwave oven, which includes a cooling fan; an air duct having a slanted surface formed at one side thereof for guiding cooling air introduced into the interior of the microwave oven from the outside thereof into a cooking chamber in cooperation with the cooling fan; and a sensor disposed the slanted surface of the air duct.

DETAILED DESCRIPTION OF THE INVENTION

Figure 1:
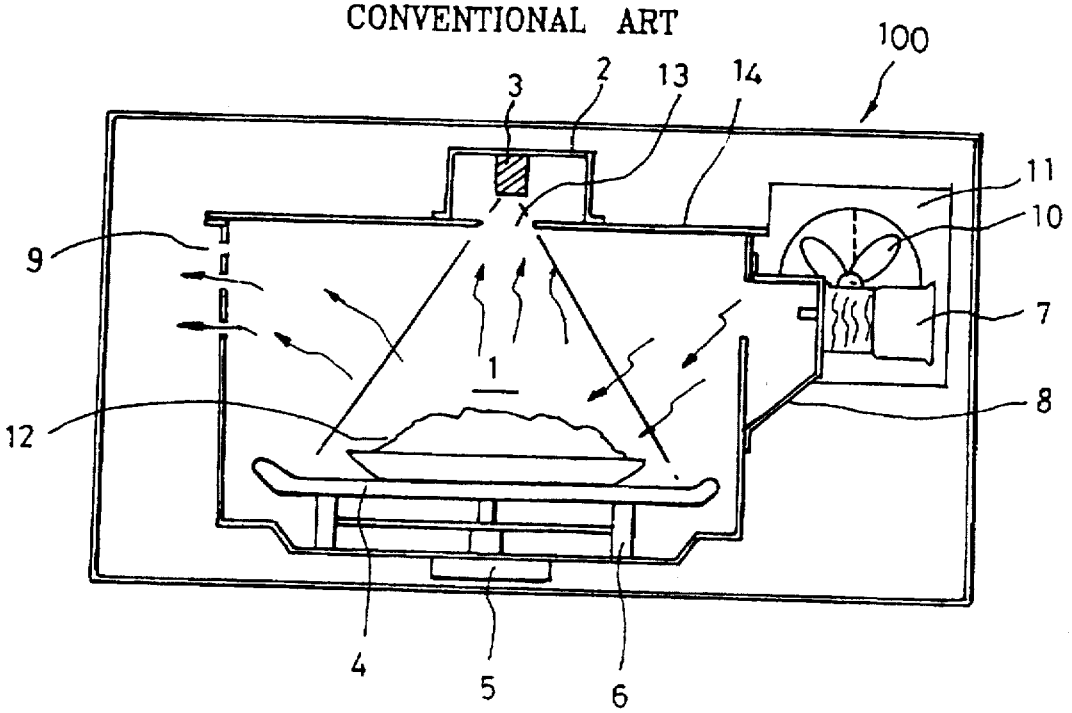
FIG. 1 CONVENTIONAL ART
FIG. 1 is a cross-sectional view showing a conventional microwave oven and a sensor operation state thereof.
Figure 2:
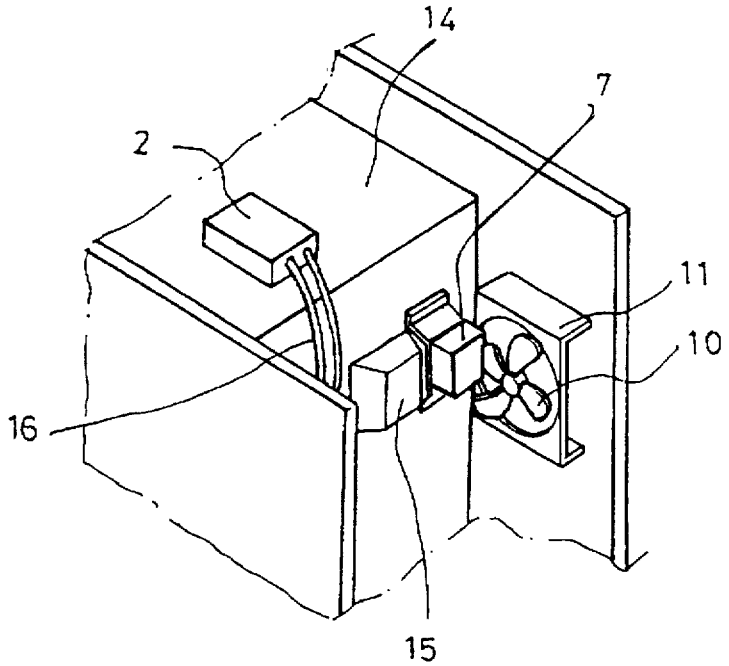
FIG. 2 CONVENTIONAL ART
FIG. 2 is a perspective view showing a conventional microwave oven equipped with a sensor.
Figure 3:
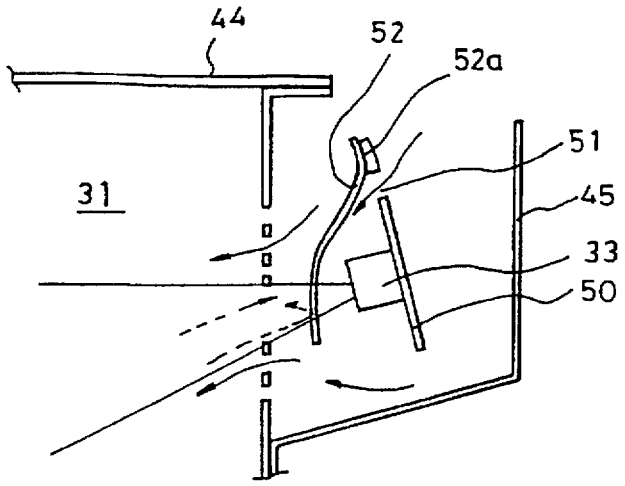
FIG. 3 is a cross-sectional view showing a microwave oven equipped with a sensor malfunction prevention apparatus and an air duct of a first embodiment according to the present invention.

FIG. 3 shows a sensor malfunction prevention apparatus of a first embodiment according to the present invention, which includes an infrared ray sensor 33 disposed at a predetermined potion of a sensor support bracket 50 disposed at a cooling air flowing path inside an air duct 45.

In addition, air openings 51 are formed at the upper portion of the sensor support bracket 50 for passing therethrough air and is spaced apart from the infrared sensor 33.

A protective cover 52 is affixed to a protective cover support 52*a* for blocking the front side of the infrared ray sensor 33.

The operation of the sensor malfunction prevention apparatus of the first embodiment according to the present invention will now be explained.

Figure 4A:
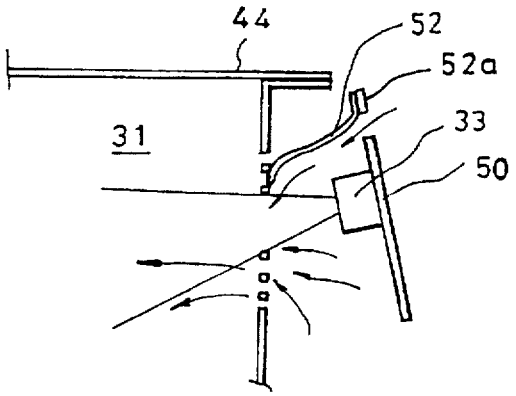
FIG. 4A is a cross-sectional view showing a microwave oven when a sensor malfunction prevention apparatus and a fan are operated, and a protective cover is lifted when a fan is operational according to a first embodiment of the present invention.

To begin with, when cooling air is introduced into the air duct 45 through the air openings 51 in cooperation with a cooling fan, as shown in FIG. 4A, the protective cover 52 is lifted, and the front side of the infrared ray sensor 33 is substantially exposed.

That is, while the cooling air is introduced into the system through the air openings 51, even though the protective cover 52 is lifted and the front side of the infrared ray sensor is exposed to the pollution materials such as heat, dust, and food debris, since the pollution materials are blocked to flow toward the infrared ray sensor 33, the surface of the same is not polluted.

The cooling air flowing direction is denoted as the arrows in FIG. 4A.

Figure 4B:
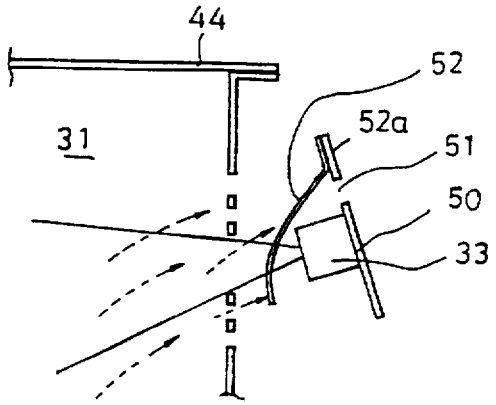
FIG. 4B is a cross-sectional view showing a microwave oven when a sensor malfunction prevention apparatus is operated, and a fan is not operational, and a protective cover prevents a sensor of a first embodiment according to the present invention.

Meanwhile, when the operation of the cooling fan is stopped and the cooling air is not introduced into the air duct 45, as shown in FIG. 4B, the cover 52 is lowered in cooperation of the force of the gravity, so that the front side of the infrared sensor 33 is blocked. In this case, even though pollution materials are introduced toward the infrared ray sensor 33, the infrared ray sensor 33 is effectively prevented from the pollution materials.

The pollution material flowing direction is indicated as the arrows in FIG. 4B which is drawn in a broken line.

At this time, the air openings 51 is designed to have a proper function of lifting up the cover 52 in cooperation with the air flowing pressure which is introduced into the air duct 45.

Meanwhile, the sensor support bracket 50 having the infrared ray sensor 33 is downwardly slanted at a certain angle. That is, the upper portion of the same is slanted in the direction of the cooking chamber.

Therefore, the protective cover 52 is movable upwardly and downwardly, and the food in the cooking chamber 31 to be cooked can be easily sensed by the infrared ray sensor 33.

Reference numeral 44 denotes a cavity upper plate.

The sensor malfunction prevention for a microwave oven of a second embodiment according to the present invention will now be explained with reference to the accompanying drawings.

To begin with, since the constructions of the first embodiment and the second embodiment are similar, only the different construction will now be explained.

Figure 5:
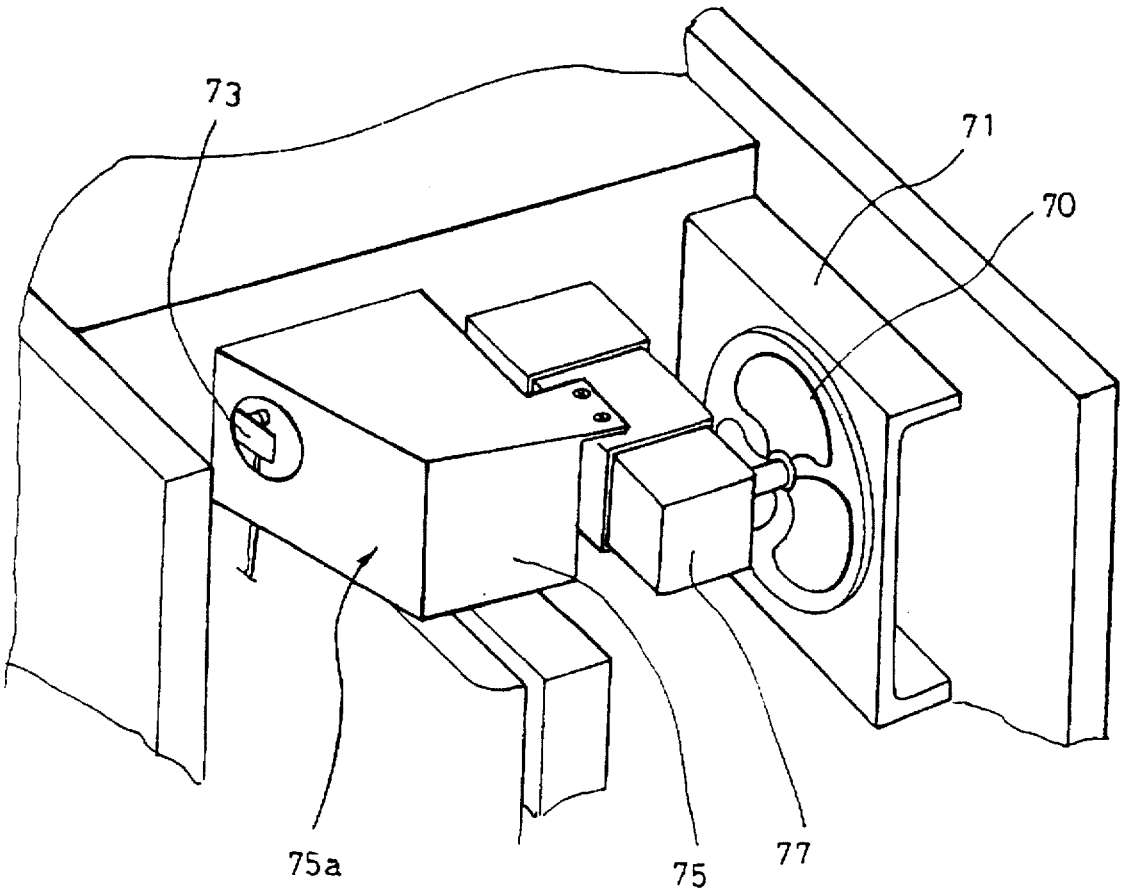
FIG. 5 is a perspective view showing a microwave oven equipped with a sensor malfunction prevention apparatus of a second embodiment according to the present invention.
Figure 6A:
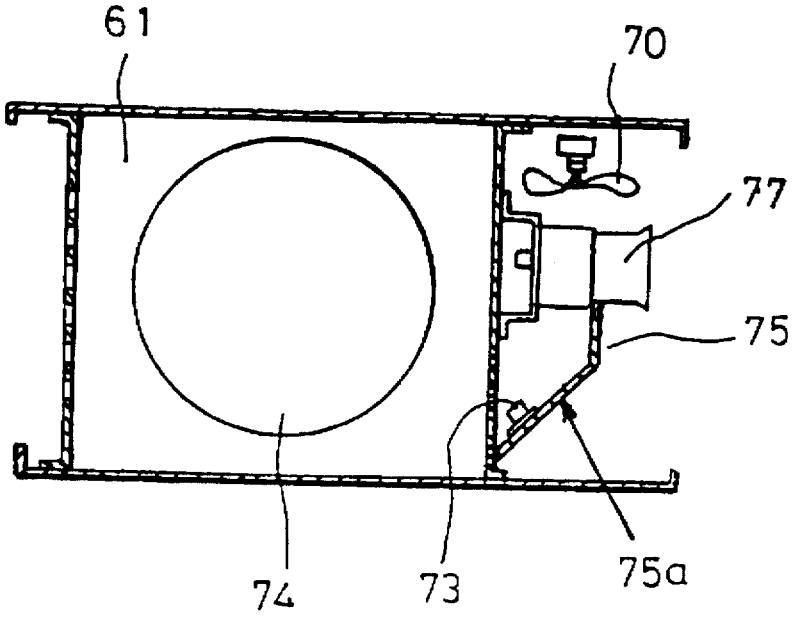
FIG. 6A is a cross-sectional view showing a sensor malfunction prevention apparatus of a microwave oven of a second embodiment according to the present invention.
Figure 6B:
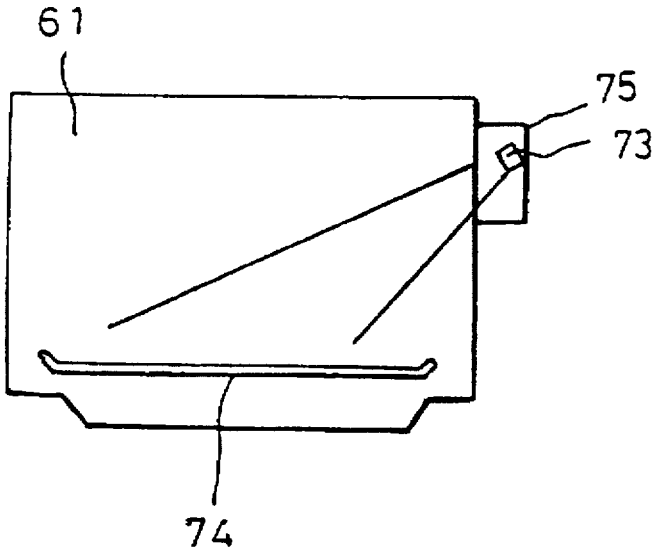
FIG. 6B is a schematic cross-sectional view to show a sensor sensing range of a sensor malfunction prevention apparatus of a microwave oven of a second embodiment according to the present invention.

As shown in FIGS. 5 and 6B, a downwardly slanted infrared ray sensor 73 is directed to sense foods on the turntable 74 at a wider angle.

Meanwhile, in this embodiment of the present invention, the infrared ray sensor 73 is disposed at a slanted surface 75*a* of the air duct 75, pollution materials such as dust, heat and food debris which generated from the cooking chamber 61 is effectively blocked to flow toward the infrared ray sensor in cooperation of flow of the cooling air introduced into the air duct 75 by a cooling fan 70.

In the drawings, reference numeral 71 denotes a cooling fan guide, and 77 denotes a magnetron.

The sensor malfunction prevention for a microwave oven of a third embodiment according to the present invention will now be explained with reference to the accompanying drawings.

To begin with, since the constructions of the first embodiment and the third embodiment are similar, only the different construction will now be explained.

Figure 7:
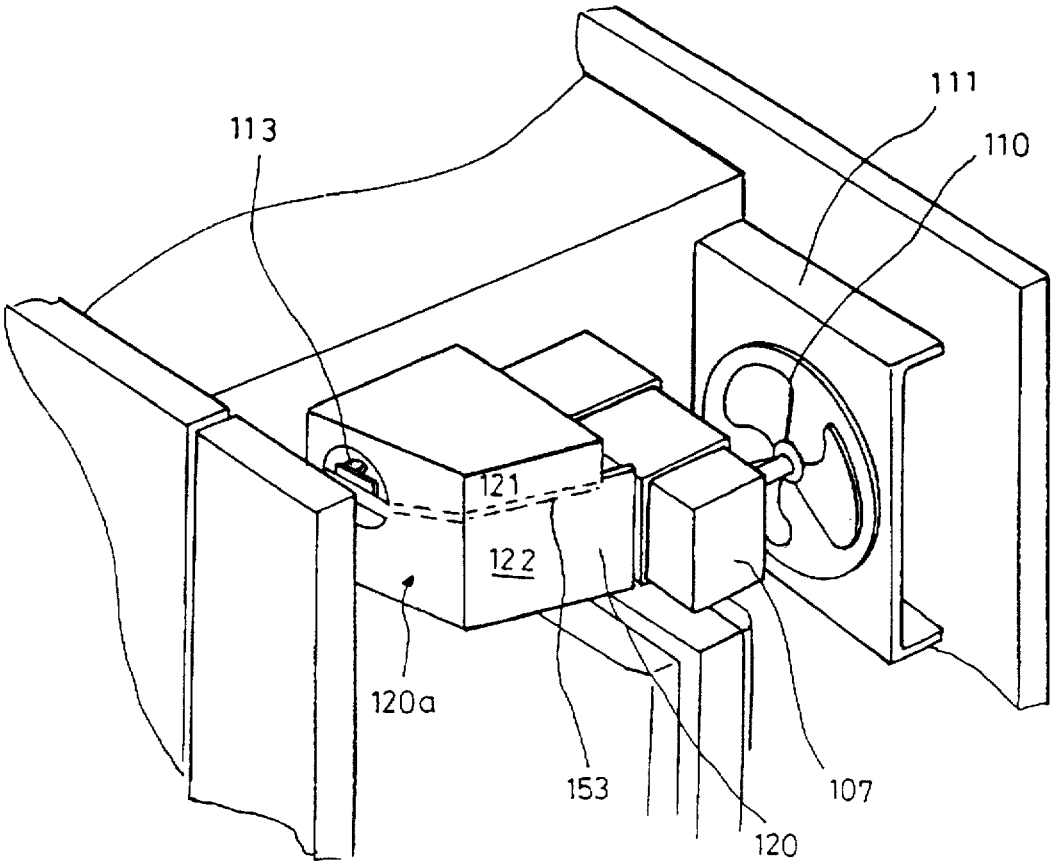
FIG. 7 is a perspective view showing a sensor malfunction prevention apparatus of a third embodiment according to the present invention.
Figure 8:
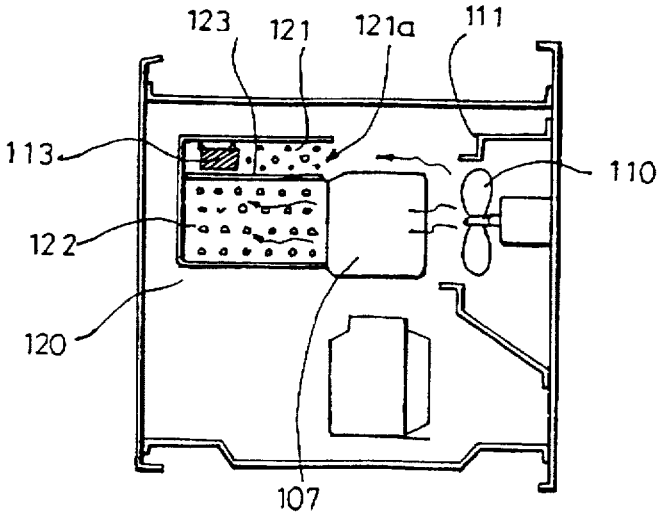
FIG. 8 is a cross-sectional view showing a sensor malfunction prevention apparatus of a third embodiment according to the present invention.

As shown in FIGS. 7 and 8, the sensor malfunction prevention apparatus of the third embodiment includes a separation plate 123 which is directed to separate an air duct 120 into an upper portion and a lower portion.

Therefore, the air duct 120 is separated into an upper path 121 and a lower path 122 by the separation plate 123, and the infrared ray sensor 113 is disposed at a predetermined portion of the upper path 121.

Here, the infrared ray sensor 113 is downwardly slanted about the slanted surface of the upper path 121.

In addition, an entrance 121*a* of the upper path 121, as shown in FIG. 8, is formed in an upper side direction of the magnetron 107 so that the cooling air flowing toward he upper portion of the magnetron 107 is effectively introduced toward the magnetron 107.

That is, the upper path 121 is formed at a certain position higher than the upper surface of the magnetron 107.

In addition, the lower path 122 is disposed at the same height as the magnetron 107 so that the cooling air can be effectively introduced from the outside of the microwave oven body toward the magnetron 107 in cooperation with the cooling fan 110.

Therefore, since the cooling air which does not contact with the magnetron 107 flows toward the upper path 121 in which the infrared ray sensor 113 is disposed, the infrared ray sensor 113 is not heated by itself, so that the malfunction of the infrared ray sensor 113 is effectively prevented.

In the drawings, reference numeral 111 denotes a cooling fan guide.

The sensor malfunction prevention for a microwave oven of a fourth embodiment according to the present invention will now be explained with reference to the accompanying drawings.

Figure 9:
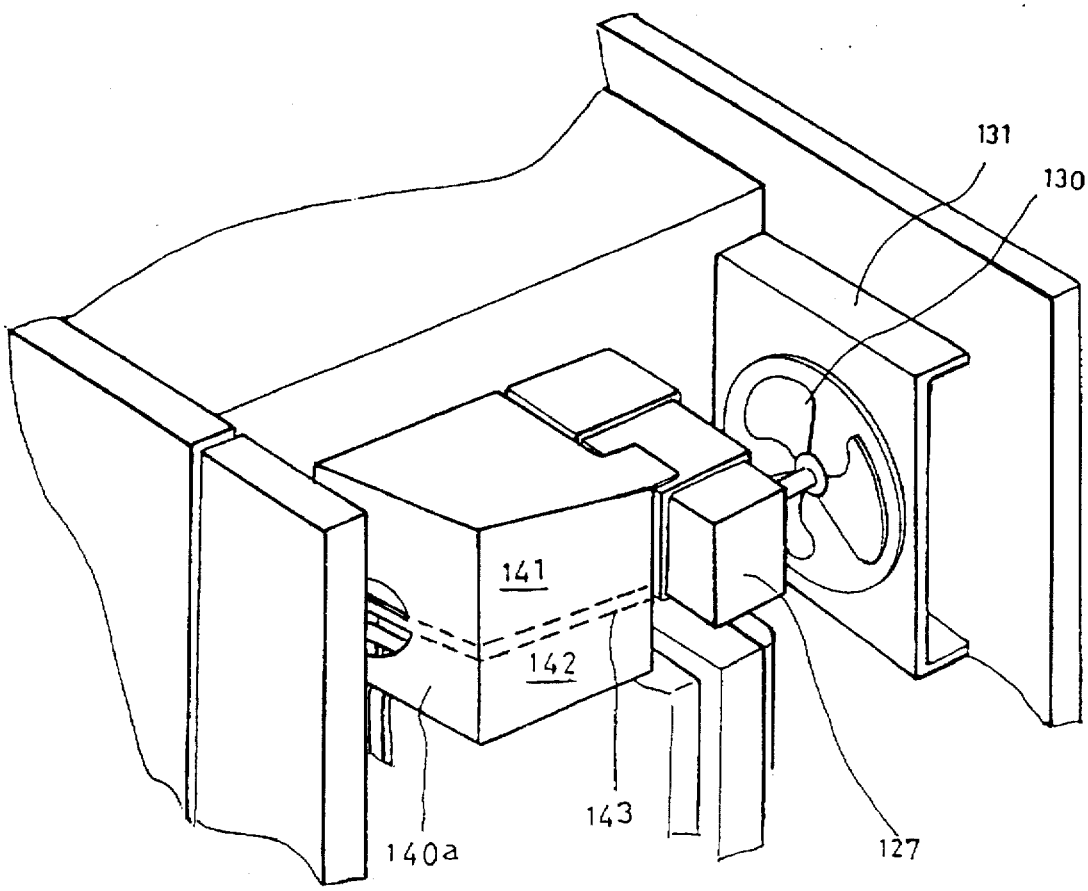
FIG. 9 is a perspective view of a sensor malfunction prevention apparatus of a fourth embodiment according to the present invention.
Figure 10:
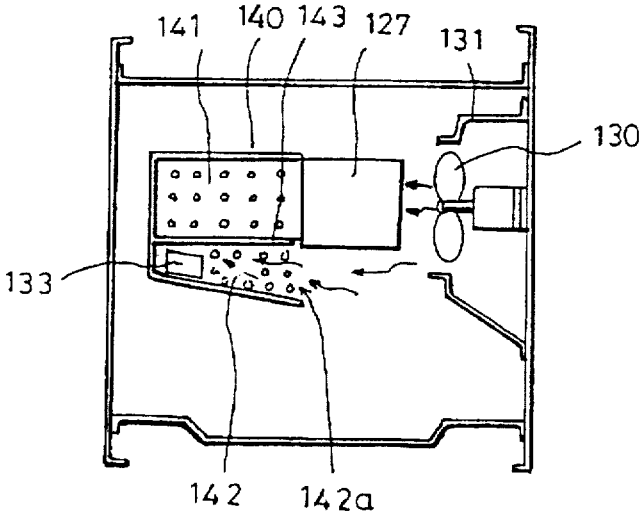
FIG. 10 is a cross-sectional view of a sensor malfunction prevention apparatus of a fourth embodiment according to the present invention.

As shown in FIGS. 9 and 10, a separation plate 143 separating the interior of the air duct 140 into an upper portion and a lower portion is disposed inside the air duct 140 of the microwave oven body.

Therefore, the air duct 140 is separated into an upper path 141 and a lower path 142 by the separation plate 143. The infrared ray sensor 133 is disposed at a predetermined portion of the lower path 142 so as to effectively sense the food in the cooking chamber of the microwave oven.

Here, the infrared my sensor 133 is downwardly slanted about the slanted surface of the lower path 142.

In addition, an entrance 142*a* of the lower path 142, as shown in FIG. 10, is downwardly formed from the magnetron 127 so that the cooling air flowing through the lower portion of the magnetron 127 can be effectively introduced toward the magnetron 127.

That is, the lower path 142 is positioned lower than the lower surface of the magnetron 127.

In addition, the upper path 141 is position at the same height as the magnetron 127 so that the cooling air introduced from the outside of the microwave oven in cooperation with the cooling fan 130 can effectively cool the magnetron 127.

Therefore, since the cooling air which does not contact with the magnetron 127 flows toward the lower path 142 in which the infrared ray sensor 133, the infrared ray sensor 133 is not heat by itself, so that the malfunction of the infrared ray sensor can be effectively prevented.

In the drawings, reference numeral 131 denotes a cooling fan guide.

As described above, the sensor malfunction prevention apparatus for a microwave oven of the present invention is directed to providing an infrared ray sensor in the air duct and a protective cover capable of effectively prevention pollution materials introduced thereto from the cooking chamber, so that malfunctions of the infrared ray sensor can be effectively prevented.

In addition, since the infrared my sensor always comes into contact with the cooling air introduced into the air duct from the outside of the microwave oven, it is possible to prevent the infrared ray sensor from being heated and being polluted from pollution materials from the cooking chamber of the microwave oven.

Although the preferred embodiments of the present invention have been disclosed for illustrative purposes, those skilled in the art will appreciate that various modifications, additions and substitutions are possible, without departing from the scope and spirit of the invention as described in the accompanying claims.

What is claimed is:

1. A microwave oven with a sensor malfunction prevention apparatus, comprising:

a cooling fan;

an air duct for guiding cooling air introduced into an interior of said microwave oven in cooperation with said cooling fan;

a sensor support bracket disposed at a predetermined inner portion of said air duct;

a sensor disposed at a predetermined portion of said sensor support bracket for sensing food temperature;

a protective cover that is transparent to light for the sensor; and a support for the protective cover, the support being disposed at an upper portion of the sensor support bracket for defining air openings between said protective cover and the sensor support bracket.

2. The microwave oven of claim 1, wherein when said cooling fan is operational and cooling air is introduced into the air duct through said air opening, said protective cover is mounted to lift off the sensor so as to expose a front side of the sensor and to be lowered by the force of the gravity so as to block the front side of the sensor when the cooling fan is not operational.

3. The microwave oven of claim 1, wherein an upper portion of said sensor support bracket, to which the sensor is fixed, is downwardly slanted at a certain angle relative to a horizontal plane associated with the microwave oven.

4. A microwave oven with an infrared ray sensor malfunction prevention apparatus, comprising:

a main body having a heating cavity therein;

a microwave generator attached to the heating cavity for radiating microwave radiation thereinto;

a cooling fan disposed adjacent the heating cavity for supplying cool air to the heating cavity and to the microwave generator;

an air duct disposed next to and in communication with the heating cavity for guiding cooling air introduced into the interior of said microwave oven by said cooling fan;

a separation plate disposed within the air duct for separating the interior of the air duct into an upper path and a lower path;

an infrared ray sensor support bracket disposed at an inner portion of said air duct;

an infrared ray sensor for sensing a surface temperature of food placed in the heating cavity, the sensor being disposed in a downwardly slanting direction at an upper portion of said infrared ray sensor support bracket;

a cover support fixed within the air duct; and a light-transparent-protective cover fixed to the support, the light transparent protective cover being liftable by the flow of cooling air to expose the sensor, and the light transparent protective cover being biased to cover the sensor in the absence of cooling air so as to block the sensor.

* * * * *